United States Patent [19]

Lu et al.

[11] 4,326,019

[45] Apr. 20, 1982

[54] POSITIVE TONERS CONTAINING LONG CHAIN HYDRAZINIUM COMPOUNDS

[75] Inventors: Chin H. Lu; Peter F. Erhardt, both of Webster, N.Y.

[73] Assignee: Xerox Corporation, Stamford, Conn.

[21] Appl. No.: 223,511

[22] Filed: Jan. 8, 1981

Related U.S. Application Data

[62] Division of Ser. No. 19,695, Mar. 12, 1979, Pat. No. 4,269,922.

[51] Int. Cl.[3] ..... G03G 9/00; G03G 13/16

[52] U.S. Cl. ..... 430/108; 430/107; 430/109; 430/110

[58] Field of Search ..... 430/107, 108, 109, 110, 430/111, 137

[56] References Cited

U.S. PATENT DOCUMENTS

| | | | |
|---|---|---|---|
| 4,264,697 | 4/1981 | Perez et al. | 430/110 |
| 4,269,922 | 5/1981 | Lu et al. | 430/110 |
| 4,291,112 | 9/1981 | Lu | 430/110 |

*Primary Examiner*—Richard L. Schilling

*Assistant Examiner*—John L. Goodrow

*Attorney, Agent, or Firm*—E. O. Palazzo

[57] ABSTRACT

Disclosed are positive toners comprised of a toner resin, pigment or colorant, and as a charge inducing material, long chain hydrazinium compounds of the following formula:

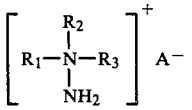

wherein $R_1$ is a hydrocarbon radical containing from about 8 to about 22 carbon atoms, $R_2$ and $R_3$ are independently selected from hydrogen groups or hydrocarbon radicals containing from about 1 to about 22 carbon atoms and A is an anion which in a preferred embodiment is selected from halides such as chloride, bromide, iodide, sulfate, sulphonate, phosphate, and nitrate. These toners, together with carrier materials can be used to develop images in electrophotographic systems.

11 Claims, No Drawings

POSITIVE TONERS CONTAINING LONG CHAIN HYDRAZINIUM COMPOUNDS

This is a division of application Ser. No. 019,695, filed Mar. 12, 1979, now U.S. Pat. No. 4,269,922.

This invention is generally directed to new toners, developers containing these new toners, and the use of such developers for causing the development of images in an electrophotographic system. More specifically the present invention is directed to positively charged toners and developers containing such toners, the toners containing certain charge inducing agents primarily for the purpose of providing positive charge on the toner material.

The electrophotographic process and more specifically the xerographic process is well known as documented in numerous prior art references.

In these processes toner materials are electrostatically attracted to the latent image areas on the photoconductive insulating surface in proportion to the charge concentration contained thereon. Many processes are known for applying the toner or electroscopic particles to the electrostatic latent image to be developed such as, for example, cascade development described in U.S. Pat. No. 3,618,552; magnetic brush development described in U.S. Pat. Nos. 2,874,063; 3,251,706; and 3,357,402; powder cloud development described in U.S. Pat. No. 2,221,776; and touchdown development described in U.S. Pat. No. 3,166,432.

It may be desirable in some instances in electrophotographic systems and particularly xerographic systems to produce a reverse copy of the original. For example, it may be desired to produce a negative copy from a positive original or a positive copy from a negative original. This is generally referred to in the art as image reversal, and in electrostatic printing such image reversal can be effected by applying to the image a developer powder which is repelled by the charged areas of the image and adheres to the discharged areas. Specifically toners possessing positive charges are found to be very useful and effective in electrophotographic reversal systems and in particular in electrophotographic systems employing organic photoreceptors which in many instances are initially charged negatively rather than positively thus necessitating the need for a positively charged toner. It is important to note that in a dual development system, that is where carrier and toner are both being employed that the toner charges positively in comparison to the charge on the carrier which is charged negatively. Most commercial machines use negatively charged toner; thus when the toner and carrier are mixed the toner acquires a negative charge and the carrier a positive charge in relationship to one another, this concept being referred to as the triboelectric relationship of the materials employed. Reversal developers are described in U.S. Pat. No. 2,986,521 these developers being comprised of electroscopic material coated with finely divided colloidal silica.

In U.S. Pat. No. 3,893,935, there is described the use of certain quaternary ammonium salts as charge control agents for electrostatic toner compositions. This patent states that certain quaternary ammonium salts when incorporated into toner materials were found to provide a particulate toner composition which exhibited relatively high uniform and stable toner charge when mixed with a suitable carrier vehicle; and which toner further also exhibited a minimum amount of toner throw off.

U.S. Pat. No. 4,079,014 contains a similar teaching with the exception that a different charge control agent is used, namely a diazyl type compound. British Patent Publication No. 1,501,065 is also of interest in that it discloses the use of certain quaternary ammonium compounds which can be used as charge control agents.

Many of the above described developers have a tendency to lose their positive charge over a long period of time, are difficult to prepare and therefore the quality of the images to be developed is adversely affected over a long period of time. Further, the use of charge control agents and developers as described in U.S. Pat. No. 3,893,935 are soluble in water causing them to be leached into the toner; surface by moisture thereby adversely affecting the machine environment, the copy quality and further such toners containing these materials are humidity sensitive. Additionally these materials are incompatible with the thermoplastic resins used in toners and it is very difficult to uniformly disperse or dissolve such materials in the toner. This causes particle to particle nonuniformity and wide distribution of electrical charge which reduces the quality of the image developed and shortens the developer life.

Accordingly, there is a need for a toner and a developer which can be used in a reverse development system and specifically the need for a positively charged toner which when used in systems requiring such toners allows the production of high quality images over a long period of time and which toners have excellent thermal stability.

SUMMARY OF THE INVENTION

It is an object of this invention to provide a toner which overcomes the above-noted disadvantages.

It is a further object of this invention to provide a developer which contains a positively charged toner and a carrier material.

Another object of this invention is the provision of a developer which contains positive toner having improved humidity insensitivity, excellent thermal stability, improved particle to particle uniformity and narrow charge distribution.

An additional object of this invention is to provide toners which will develop electrostatic images containing negative charges on the photoreceptor surface and which will transfer effectively electrostatically from such a photoreceptor to plain bond paper without causing blurring or adversely affecting the quality of the resulting images.

Yet another object of this invention is to provide charge inducing materials which are completely compatible with the toner resin.

An additional object of this invention is the provision of developers which have rapidly fast charging rates, excellent admix charging characteristics, high melting points (good thermal stability), and low moisture absorption.

These and other objects of the present invention are accomplished by providing toners comprised of a toner resin, pigment or colorant, and as a charge inducing material long chain hydrazinium compounds of the following formula:

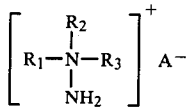

wherein $R_1$ is a hydrocarbon radical containing from about 8 to about 22 carbon atoms, $R_2$ and $R_3$ are independently selected from hydrogen groups or hydrocarbon radicals containing from about 1 to about 22 carbon atoms and A is an anion which in a preferred embodiment is selected from halides such as chloride, bromide, iodide, sulfate, sulphonate, phosphate and nitrate.

Illustrative examples of the $R_1$, $R_2$, and $R_3$ hydrocarbon radicals which radicals can be either aliphatic or aromatic, include for example methyl, ethyl, propyl, butyl, isobutyl, pentyl, hexyl, heptyl, octyl, nonyl, decayl, lauryl, myristyl, cetyl, oleoyl, pentadecyl, heptadecyl, octadecyl, benzyl and phenyl.

Illustrative examples of long chain hydrazinium compounds useful in the present invention include for example N,N-dimethyl, N-cetyl hydrazinium chloride, N,N-dimethyl N-lauryl hydrazinium bromide, N,N-dimethyl N-cetyl hydrazinium para-toluene sulfonate, N,N-dimethyl N-lauryl hydrazinium chloride, cetyl dimethyl hydrazinium chloride, cetyl dimethyl hydrazinium bromide, N,Ndimethyl hydrazinium paratoluene sulfonate, stearyl methyl benzyl hydrazinium chloride, lauryl dimethyl hydrazinium nitrate, and the like. Other compounds not specifically listed herein may also be useful providing they do not adversely affect the system. This listing is not intended to limit the scope of the present invention.

The amount of long chain hydrazinium compounds used can vary over wide ranges but generally any amount that results in a toner that is charged positively in comparison to the carrier and that develops and electrostatically transfers well is envisioned. For example, the amount of long chain hydrazinium compound present ranges from about 0.1 weight percent to 10 weight percent and preferably 0.5 weight percent to 5 weight percent of the total toner weight. The long chain hydrazinium compound can either be blended into the system or coated on the pigment or colorant such as carbon black when used in the developing compositions. When coated the long chain hydrazinium compound is present in about 1 percent to 6 percent by weight of the pigment or colorant, and preferably from about 2 percent to about 4 percent by weight of the pigment.

The toner of the present invention can be employed together with a carrier, these two materials in combination being referred to as the developer composition. In this developer composition the toner becomes positively charged in view of the presence of the long chain hydrazinium compounds, with the carrier being charged negatively. Further details as to the sizes and proportions of carrier materials are described hereinafter.

Several different numerous methods can be utilized to produce the toner of the present invention, one such method involving melt blending the resin and the pigment coated with the long chain hydrazinium compound followed by mechanical attrition. Other methods include those well known in the art such as spray drying, melt dispersion and dispersion polymerization. For example, a solvent dispersion of resin pigment and long chain hydrazinium compound are spray dried under controlled conditions thereby resulting in the desired product. Such a toner prepared in this manner results in a positive charged toner in relation to the carrier and these toners exhibit the improved properties as mentioned herein.

Any suitable thermoplastic resin may be employed as part of the toner composition of the present invention; typical resins including for example polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene vinyl naphthalene, ethylenecally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenol-formaldehyde resins, oil modified epoxy resins, polyurethane resins, cellulosic resins, polyether resins and mixtures thereof.

Also esterification products of a dicarboxylic acid and a diol comprising a diphenol may be used as a preferred resin material for the toner composition of the present invention. These materials are illustrated in U.S. Pat. No. 3,655,374 totally incorporated herein by reference, the diphenol reactant being of the formula as shown in Column 4 beginning at line 5 of this patent and the dicarboxylic acid being of the formula as shown in Column 6 of the above patent. The resin is present in an amount so that the total of all ingredients used in the toner total about 100 percent, thus when 5 percent by weight of the long chain hydrazinium compound is used and 10 percent by weight of the pigment such as carbon black, about 85 percent by weight of resin material is used.

Optimum electrophotographic resins are achieved with styrene butylmethacrylate copolymers, styrene vinyl toluene copolymers, styrene acrylate copolymers, polyester resins, predominantly styrene or polystyrene base resins as generally described in U.S. Pat. No. Re. 25,136 to Carlson and polystyrene blends as described in U.S. Pat. No. 2,788,288 to Rheinfrank and Jones.

The toners used in the present invention can as previously disclosed, be prepared by various known methods, such as spray drying. In the spray drying method the appropriate polymer is dissolved in an organic solvent like dichloromethane. The toner colorant and long chain hydrazinium compound are also added to the solvent. This solution is then sprayed through an atomizing nozzle using an inert gas such as nitrogen, as the atomizing agent. The solvent evaporates during atomization, resulting in toner particles of a pigmented resin. Particle size of the resulting resin varies depending on the size of the nozzle, however, particles of a diameter between about 0.1 micrometers and about 100 micrometers generally are obtained. Melt blending processes can also be used for preparing the toner compositions of the present invention. This involves melting a powdered form of an appropriate polymeric resin and mixing it with suitable colorants such as pigments, and the long chain hydrazinium Tcompound of the present invention. The resin can be melted by heated rolls, which rollers can be used to stir, and blend the resin. After thorough blending the mixture is cooled and solidified. The solid mass that results is broken into small pieces and subsequently finely ground so as to form free flowing toner particles, which range in size of from 0.1 to about 100–200 microns.

Any suitable pigment or dye may be employed as the colorant for the toner particles, such materials being known and including for example, carbon black, magnetite, nigrosine dye, aniline blue, calco oil blue, chrome yellow, ultramarine blue, DuPont oil red, methylene blue chloride, phthalocyanine blue and mixtures thereof. The pigment or dye should be present in the toner and in sufficient quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products Inc. Preferably the pigment is employed in amounts from about 3 percent to about 20 percent by weight based on the total weight of toner, however, if the toner colorant employed is a dye, substantially smaller quantities of the colorant may be used. When magnetite is employed as the colorant, approximately 20 weight percent to 70 weight percent of the total weight of toner is used. Other pigments that may be useful include for example, gilsonite, Prussian blue and various iron oxides.

Any suitable carrier material can be employed as long as such particles are capable of triboelectrically obtaining a charge of opposite polarity in that of the toner particles. In the present invention in one embodiment that would be a negative polarity, to that of the toner particles which are positively charged so that the toner particles will adhere to and surround the carrier particles. Thus the carriers can be selected so that the toner particles acquire a charge of a positive polarity and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like. The carriers can be used with or without a coating. Many of the typical carriers that can be used are described in U.S. Pat. Nos. 2,618,441; 2,638,416; 2,618,522; 3,591,503; 3,533,835; and 3,526,533. Also nickel berry carriers as described in U.S. Pat. Nos. 3,847,604 and 3,767,598 can be employed, these carriers being modular carrier beads of nickel characterized by a surface of reoccurring recesses and protrusions providing particles with a relatively large external area. The diameter of the coated carrier particle is from about 50 to about 1000 microns, thus allowing the carrier to possess sufficient density and inertia to avoid adherence to the electrostatic images during the development process. Coated carrier particles include materials such as steel coated with various fluorocarbons, like polytetrafluoroethylene, polyvinylidene fluoride, mixtures thereof, and the like. Also useful are magnetic carrier particles such as iron, cobalt, nickel, and the like.

The carrier may be employed with the toner composition in any suitable combination, however, best results are obtained when about 1 part per toner is used and about 10 to about 200 parts by weight of carrier.

Toner compositions of the present invention may be used to develop electrostatic latent images on any suitable electrostatic surface capable of retaining charge including conventional photoconductors, however, the toners of the present invention are best utilized in systems wherein a negative charge resides on the photoreceptor and this usually occurs with organic photoreceptors, illustrative examples of such photoreceptors being polyvinyl carbazole, 4-dimethylamino benzylidene, benzhydrazide; 2-benzylideneamino-carbazole, 4-dimethylamino-benzylidene, benzhydrazide; 2-benzylideneamino-carbazole, polyvinyl carbazole; (2-nitrobenzylidene)-p bromoaniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazoletritrofluorenone charge transfer complex; phthalocyanines and mixtures thereof.

The following examples are being supplied to further define the species of the present invention, it being noted that these examples are intended to illustrate and not limit the scope of the present invention. Parts and percentages are by weight unless otherwise indicated.

EXAMPLE I

A toner was prepared by melt blending followed by mechanical attrition comprised of 6 percent by weight of Regal 330 carbon black, commercially available from Cabot Corporation, 92 percent of a 65/35 copolymer resin of styrene/n-butyl methacrylate, and 2 percent by weight of N,N dimethyl N-cetyl hydrazinium chloride. The toner was classified to remove particles having average diameters below 5 microns, and 3 parts of the classified toner and 100 parts of a 0.15 percent of vinylidene fluoride resin coated Hoeganaes steel carrier were blended into a developer. The developer was used in a device containing a polyvinylcarbazole photoreceptor that charged negatively, and good quality prints were obtained with high optical density and low background. Admix experiments indicated the developer had very fast charging characteristics and very narrow charge distribution. The carbon black dispersion and particle to particle uniformity were excellent as determined by transmission electron microscope techniques.

The triboelectric charge of the toner was measured by blowing off the toner from the carrier in a Faraday cage.

| Roll Mixing Time | Toner Tribo μc/g (Microcoulombs/Gram) |
|---|---|
| 1 minute | +48 |
| 10 minutes | +49 |
| 1 hour | +47 |
| 4 hours | +44 |

EXAMPLE II

The procedure of Example I was repeated with the exception that N,N-dimethyl N-cetyl hydrazinium para-toluene sulphonate was used in the place of N,N dimethyl N-cetyl hydrazinium chloride and substantially similar results were obtained that is the developer when tested in the device used with the photoreceptor charge negatively resulted in good quality prints with high optical density and low background. Further the triboelectric charge of the toner prepared was measured by blowing off the toner from the carrier in a Faraday cage with the following results.

| Roll Mixing Time | Toner Tribo μc/g (Microcoulombs/Gram) |
|---|---|
| 1 minute | +49 |
| 10 minutes | +43 |
| 1 our | +37 |
| 4 hours | +27 |

EXAMPLE III

A toner comprised of 10 percent Raven 420 carbon black commercially available from Cities Service Co., 2 percent N,N-dimethyl N-lauryl hydrazinium bromide, and 88 percent of a 65/35 copolymer resin of styrene/n-butyl methacrylate was prepared by melt blending followed by mechanical attrition. The toner was classified to remove particles which have a diameter of less than 5 microns. Three parts of the resulting classified toner and 100 parts of a 0.35 percent perfluoro alkoxy fluoro polymer coated Hoeganaes steel carrier were blended into a developer. The developer was tested in a device as described in Example I. Good quality prints of high solid area density and very low background density were obtained.

EXAMPLE IV

A toner comprised of 10 percent of Regal 330 carbon black coated with N,N-dimethyl N-cetyl hydrazinium chloride, 90 percent 65/35 of styrene/n-butyl methacrylate copolymer resin was prepared by melt blending followed by mechanical attrition. The coating weight of the charge inducing agent was 4.0 percent based on the weight of the carbon black. The toner was classified to remove the particles having a diameter of less than 5 microns. Three parts of the classified toner and 100 parts of the carrier as described in Example III were blended into developer. The developer was tested in a device containing a polyvinyl carbazole photoreceptor that charged negatively. Good quality prints of excellent print density were obtained.

The melting point and moisture absorption of N,N-dimethyl N-cetyl hydrazinium chloride (I) and N,N-dimethyl hydrazinium para-toluene sulfonate (II) were determined with the following results:

| | I | II |
|---|---|---|
| Melting Point °C. | 125–128 | 167–172 |
| Moisture Content % | | |
| 20% Relative Humidity | .05 | 0 |
| 51% Relative Humidity | .18 | .12 |
| 81% Relative Humidity | .21 | .11 |

Other modifications of the present invention will occur to those skilled in the art upon a reading of the present disclosure. These are intended to be included within the scope of this invention.

What is claimed is:

1. A positively charged toner composition comprised of a resin, a colorant and a long chain hydrazinium compound of the formula:

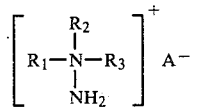

wherein $R_1$ is a hydrocarbon radical containing from 8 to 22 carbon atoms, $R_2$ and $R_3$ are independently selected from hydrogen or hydrocarbon radicals containing from 1 to 22 carbon atoms, and A is an anion selected from halides, sulfate, sulphonate, phosphate and nitrate.

2. A toner in accordance with claim 1 wherein $R_1$ is cetyl, $R_2$ and $R_3$ are methyl and A is chloride.

3. A toner in accordance with claim 1 wherein the long chain hydrazinium compound is N,N dimethyl N cetyl hydrazinium chloride.

4. A toner in accordance with claim 1 wherein the long chain hydrazinium compound is N,N-dimethyl N-lauryl hydrazinium chloride.

5. A toner in accordance with claim 1 wherein the long chain hydrazinium compound is N,N-dimethyl N-cetyl hydrazinium para-toluene sulfonate.

6. A toner in accordance with claim 1 wherein the long chain hydrazinium compound is N,N-dimethyl N-lauryl hydrazinium bromide.

7. A toner in accordance with claim 1 wherein the resin is a copolymer of a styrene/n-butyl methacrylate, the colorant is carbon black and the long chain hydrazinium compound is N,N-dimethyl N-cetyl hydrazinium chloride.

8. A toner in accordance with claim 1 wherein the long chain hydrazinium compound is present in an amount of from 0.1 percent to 10 percent based on the weight of toner.

9. A toner in accordance with claim 1 wherein the colorant is coated with the long chain hydrazinium compound in an amount of from 1 percent to 6 percent by weight of the colorant.

10. A toner in accordance with claim 1 wherein a carrier material is added to the composition thereby resulting in a developer material wherein the toner is charged positively and the carrier is charged negatively.

11. A toner in accordance with claim 10 wherein the carrier is selected from polyvinylidene fluoride coated steel carrier or vinyl fluoride resin coated steel carrier.

* * * * *